United States Patent [19]

Hooker

[11] 4,037,845

[45] July 26, 1977

[54] AMUSEMENT APPARATUS

[75] Inventor: Donald E. Hooker, Wilmette, Ill.

[73] Assignee: Bally Manufacturing Corporation, Chicago, Ill.

[21] Appl. No.: 647,905

[22] Filed: Jan. 9, 1976

Related U.S. Application Data

[63] Continuation-in-part of Ser. No. 558,340, March 14, 1975, abandoned.

[51] Int. Cl.[2] ..... A63F 5/04

[52] U.S. Cl. ..... 273/138 A; 273/143 R

[58] Field of Search ..... 273/138 A, 143 R, 143 A, 273/143 B, 143 C, 143 D, 143 E.

[56] References Cited

U.S. PATENT DOCUMENTS

| | | | |
|---|---|---|---|
| 2,579,241 | 12/1951 | Nicolaus | 273/138 A X |
| 2,641,473 | 6/1953 | Stalter | 273/138 A |
| 2,665,914 | 1/1954 | Nicolaus | 273/138 A |
| 2,812,182 | 11/1957 | Fiorino | 273/143 R |
| 3,642,287 | 2/1972 | Lally et al. | 273/143 R |
| 3,733,075 | 5/1973 | Hooker et al. | 273/143 R |
| 3,918,716 | 11/1975 | Nonaka et al. | 273/138 A |

*Primary Examiner*—Harland S. Skogquist
*Assistant Examiner*—Arnold W. Kramer
*Attorney, Agent, or Firm*—Hibben, Noyes & Bicknell, Ltd.

[57] ABSTRACT

An amusement apparatus having a plurality of symbol displaying elements, such as rotatable reels, with some of said symbols on the display elements being "Win" symbols having potential score values and others being "Hold" symbols without score values and said display elements adapted to randomly index in a viewing area during a play cycle a combination of said symbols with or without other symbols or "Blanks" having no value, and control elements associated with the changeable symbol display elements which are adapted to modify the random indexing of the symbols by holding automatically in indexed position in the viewing area any "Win" symbols during the play cycle immediately following a play cycle in which the "Win" symbol and a "Hold" symbol have been simultaneously indexed in the viewing area of the apparatus so that a winning combination of symbols may be automatically built-up in a series of play cycles before all of the symbol display elements are again changed and randomly indexed.

6 Claims, 15 Drawing Figures

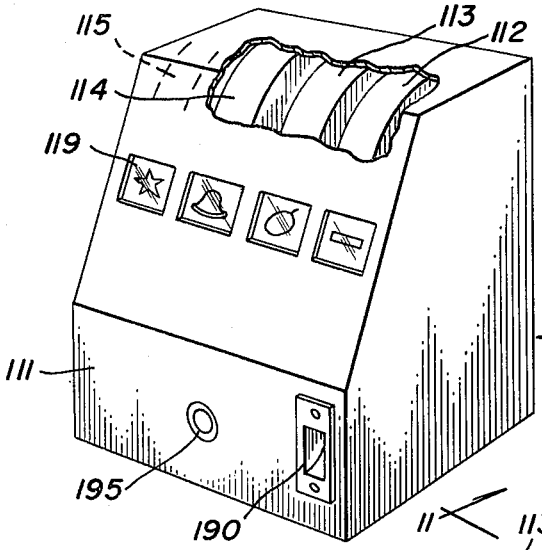
FIG. 7
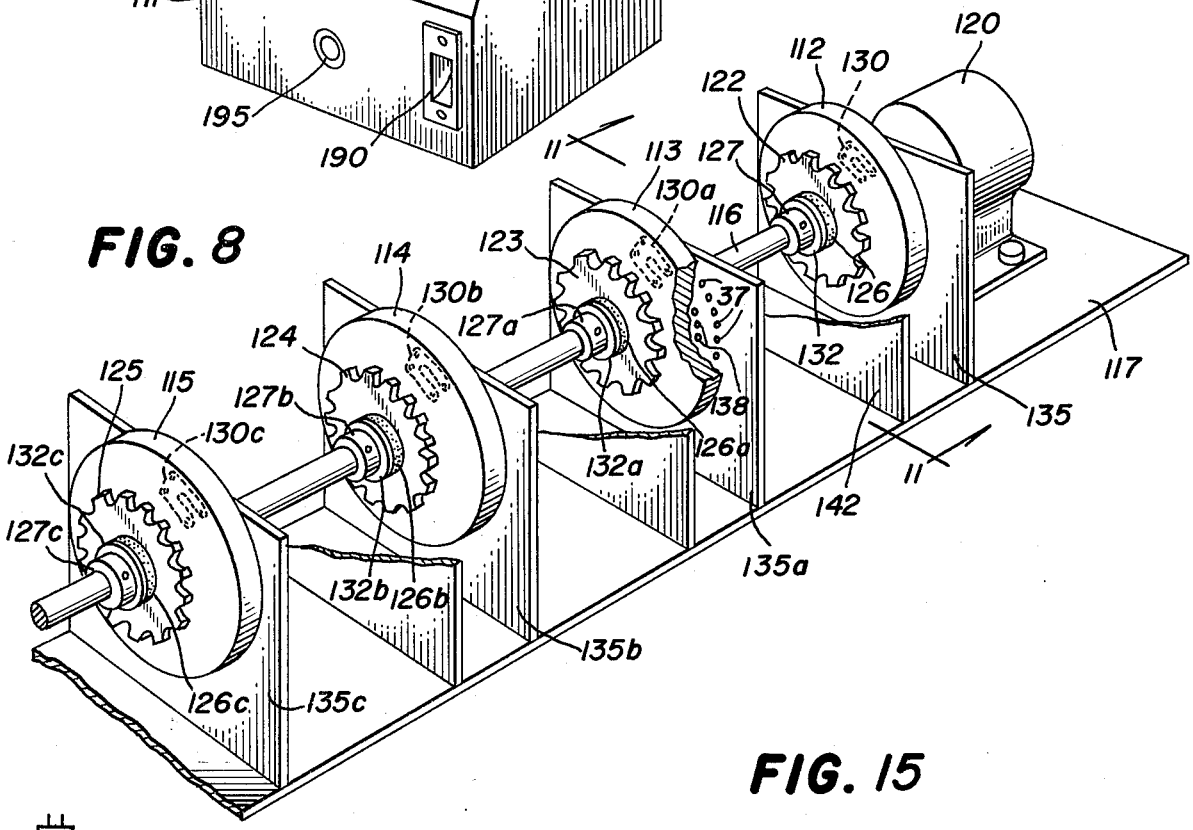
FIG. 8
FIG. 15
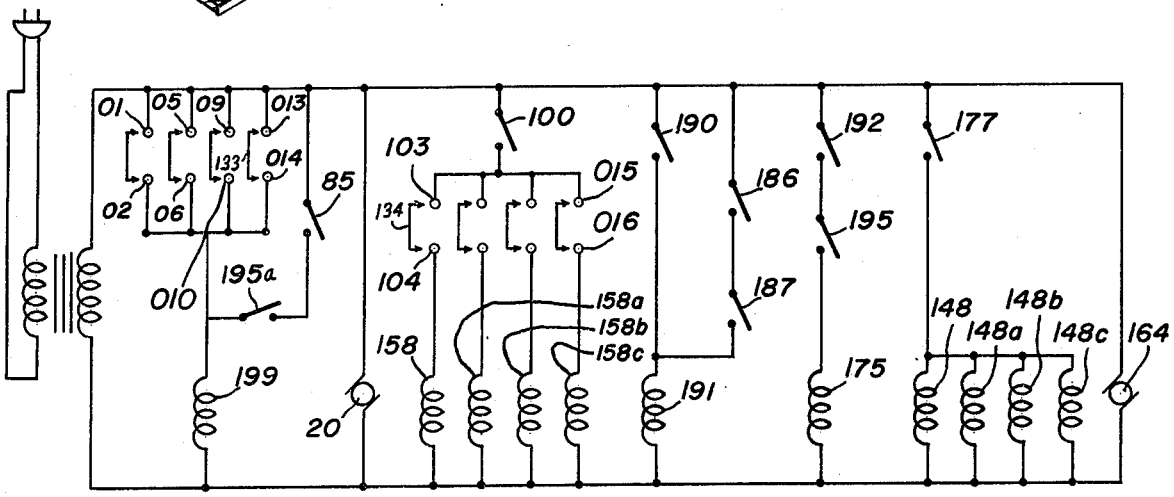

AMUSEMENT APPARATUS

This application is a continuation-in-part application of co-pending application Ser. No. 558,340, filed Mar. 14, 1975, now abandoned.

The present invention relates generally to an amusement apparatus in which permutations and combinations are formed by changeable symbol-bearing means which are indexed in variously changed relative positions so as to display in a player viewing area different combinations of the symbols some of which have score award value.

Generally, the amusement apparatus of the present invention comprises three or four symbol display means, such as rotatable symbol bearing reels, for presenting a plurality of changeable symbols within a viewing area with the symbols in side-by-side relationship to effect forming in a horizontal row a combination of symbols which have a predetermined play value.

The means for providing the changeable symbols in the viewing area can comprise a plurality of electro-mechanical rotatable drums or electro-optical reels mounted in side-by-side relationship. The electro-optical reels or the more conventional mechanical rotatable drums having symbols on the periphery thereof are generally actuated by a player depressing a starting button or pulling a hand lever. At the end of a normal play cycle the sequential change of symbols is stopped or "indexed" at random by electronic, electrical or mechanical means with each reel or drum displaying a symbol in the player viewing area and together forming one or more horizontal rows with certain of the symbol combinations being winning combinations entitling the player to a score or reward.

In one prior art amusement apparatus of the foregoing type (see U.S. Pat. No. 2,579,241) a player is given the option of actuating a "Hold" mechanism which will lock one or more of the indexed symbols having potential score value (i.e. a "Win" symbol) in a viewing area during the next play cycle with the object of forming a winning combination of the "Win" symbols or a combination having a higher score value. After the "Hold" mechanism is actuated in the aforementioned apparatus the player is allowed only one play before all of the reels are again allowed to rotate so that a random indexing of all the reels is effected and a new series of play, or game, must commence. The foregoing apparatus and method of play has not been particularly successful, however, because the player is required to make a judgment at the end of each play cycle and, if not successful, the player wll often become discouraged or lose confidence and stops playing.

It is therefore an object of the present invention to provide an improved amusement apparatus having means which permits automatically building-up a winning combination of symbols during a single game comprising a continuing series of play cycles without requiring the player to exercise any judgment during play of the apparatus.

It is a further object of the present invention to provide an improved amusement apparatus of the foregoing type in which a winning combination can be built-up automatically during a game by a series of several plays before requiring an entirely new game and sequence of plays to commence.

It is still another object of the present invention to provide an improved apparatus and method of operating and controlling an amusement apparatus of the foregoing type which stimulates and prolongs interest in the play of the apparatus.

It is also an object of the present invention to provide an improved control circuit and means for operating an amusement apparatus of the type herein disclosed.

Other objects of the present invention will be apparent to one skilled in the art from the following detailed description and claims when read in conjunction with the accompanying drawing, wherein:

FIG. 7 is a perspective view of a modified form of amusement apparatus embodying the present invention;

FIG. 8 is a perspective schematic view of a portion of an operating mechanism of the apparatus of FIG. 7;

FIG. 15 is a schematic diagram of an electrical circuit of the apparatus of FIGS. 7–14.

In accordance with the present invention, an amusement apparatus of the instant type is provided with means for automatically holding any "Win" symbols, such as a one, two or three gold bar symbol or other arbitrary symbols having a potential score value, in its "indexed" position during the next succeeding play cycle and on each following play cycle if, but only if, a "Hold" symbol has been simultaneously displayed in the viewing area on one of the other symbol display means in combination with the "Win" symbol in the immediately preceding play cycle. In this way the apparatus can automatically build-up a winning combination of symbols by a series of plays in which some of the symbols are held in indexed position.

Figure 1:
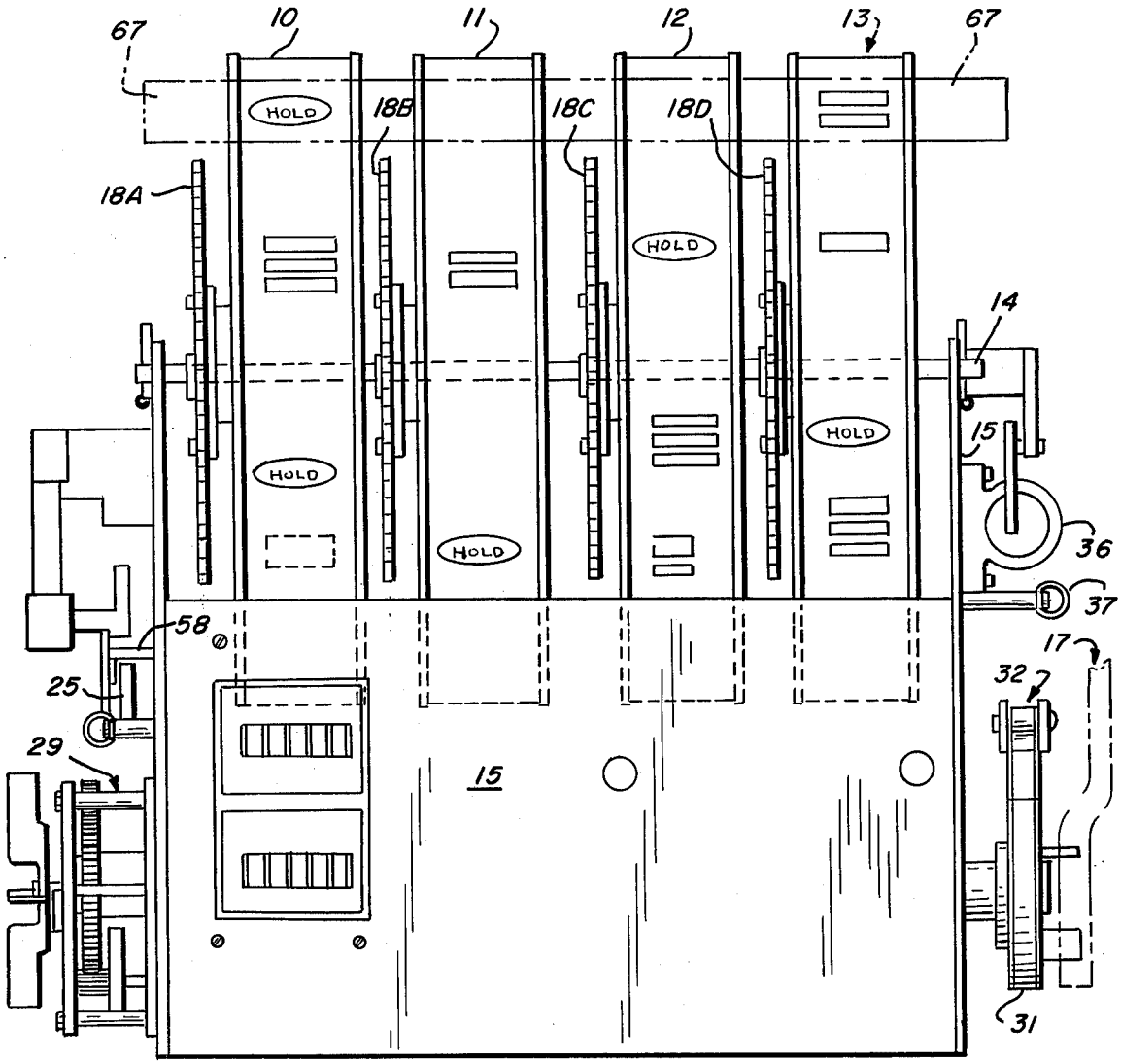
FIG. 1 is a front elevational view of a four-reel apparatus of the class described.

As depicted in FIG. 1, the amusement apparatus can comprise a set of four reels 10, 11, 12 and 13, all arranged to spin about a common axis on a shaft 14 removably seated on top of a chassis structure 15. All four reels, as well as the mechanism for spinning and indexing the same, can be substantially in the known form disclosed in U.S. Pat. No. 2,579,241 to Nicolaus, and only so much of the said Nicolaus patent incorporated herein by reference is reproduced and described herein as is deemed necessary to provide an understanding of the purposes, construction, and mode of operation of the novel automatic hold feature and associated control and circuit means comprising the present invention.

A reel-spinning or operating cycle of the device is initiated upon release of a master control and lockout means, as by the insertion of a coin in the apparatus and actuating the manual operating lever 17. The lever 17 will activate the reel spinning system beginning with a counterclockwise motion of the gear sector 30 (see FIGS. 2 and 3) transmitting effort through gear sector 31 and rod means 32 to a cocking lever 33 floating on cross-shaft 22, the latter shaft being turned clockwise as the result of rocking of an associated trip lever 34 fixed on the shaft 22 and coupled to lever 33 by a trip-out cam 33A on lever 33 and abutting lever 34 until the shaft has turned far enough to cause the tail of the cam 33A to strike a tripping lug 35 on the chassis.

During initial (clockwise) or cocking motion of trip lever 34 (toward the dotted-line position in FIG. 2) its spring 37 is tensioned, and when the coupling cam 33A is tripped out, lever 34 abruptly reverses and begins its return working counterclockwise stroke to turn the shaft 22, on which it is secured, independently of the cocking lever 33, the latter returning to its starting position slowly under restraint of the air dashpot 36.

Figure 3:
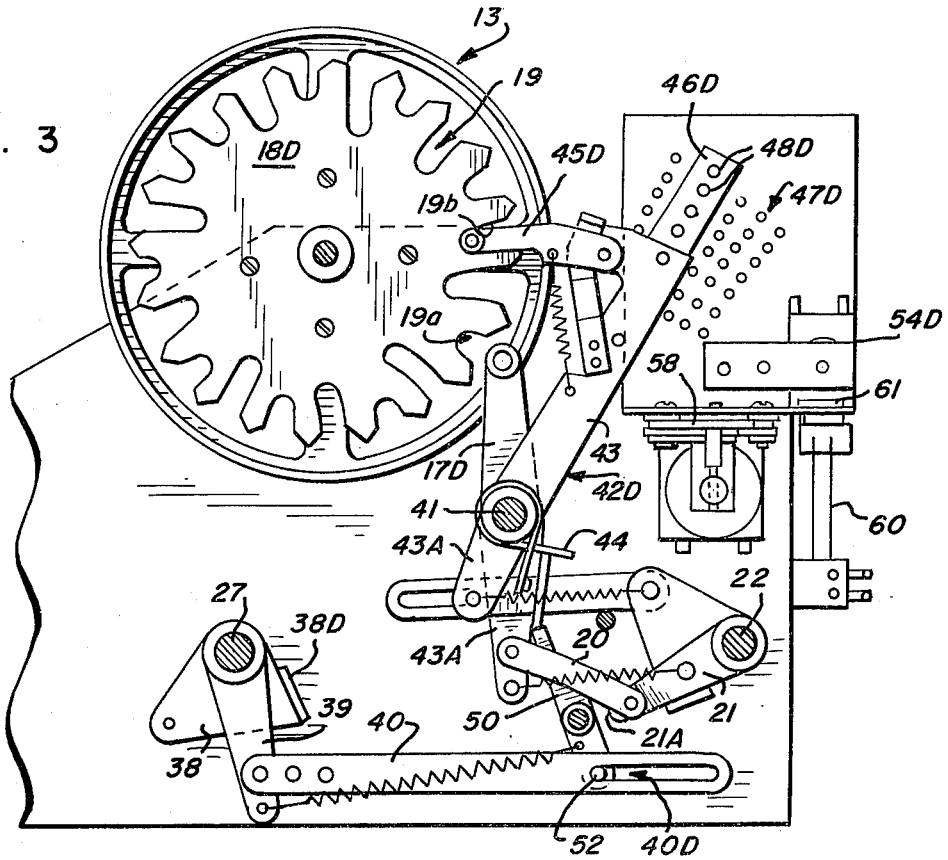
FIG. 3 is a fragmentary cross sectional view of the apparatus of FIG. 2 showing parts of the reel-spinning and indexing mechanism in elevational view.

As a result of the aforesaid cocking and turning of shaft 22, the reel spinning systems is activated to cause a spinning lever 17A, 17B, 17C, 17D associated with each of the reels 10, 11, 12, 13, respectively, such as the lever 17D of reel 13 shown in FIG. 3, to project its upper end into one of the variable-depth selector slots 19 on each of the selector discs 18A, 18B, 18C, 18D, each coaxially rotatable with an associated reel, which action turns the reel slightly by reason of the pitch of the slot so that when the lever 17D, for example, is rapidly withdrawn therefrom the reel 13 will be caused to spin rapidly. At the same time the corresponding selector or indexing lever means 42A, 42B, 42C, 42D also associated with the selector discs 18A, 18B, 18C, 18D, respectively, such as the indexing lever means 42D in FIG. 3, is turned clockwise to withdraw its detecting finger 45D from the slot **19*b* of reel 13 in which it happens to be engaged at the moment in order that the reel may be free to spin. Each of the foregoing movements is a phase in the cocking operation before the trip lever 34** begins its return or working stroke.

Each of the indexing lever means 42A, 42B, 42C, 42D normally will be momentarily held in the aforesaid withdrawn condition by a corresponding holding toggle lever system including toggle levers 20 and 21 (FIG. 3), which straighten out in substantial horizontal toggle alignment and are so held by a corresponding trigger lever 50 having a notched end which engages beneath the end 21A of the appertaining toggle lever 21 for this purpose.

Meanwhile, as lever 34 trips out, the spinning lever 17D (FIG. 3) rocks reversely (clockwise) to disengage the slot **19*a* abruptly, and in doing so imparts a moderate spinning impetus to the disc 18D and associated reel 13; and after a short delay the toggle trigger 50 will be rocked to break the holding toggle levers 20 and 21 and free the detecting finger means 45D for entry into some one of the disc slots 19 to stop the disc (as at 19*b* in FIG. 3) and thereby determine the resting or "indexed" position of the associated movable selector contact wiper 46D on the corresponding contact bank 47D**.

Figure 2:
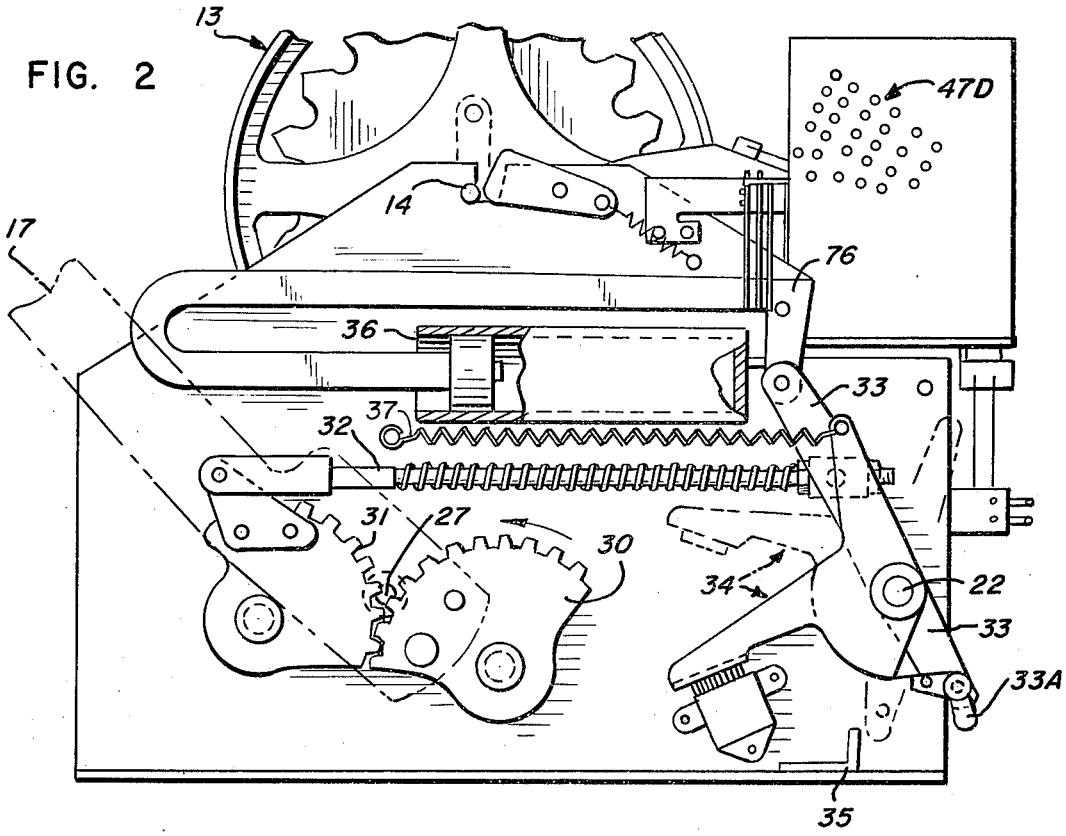
FIG. 2 is a fragmentary elevational view of the right-hand side of the apparatus of FIG. 1.
Figure 4:
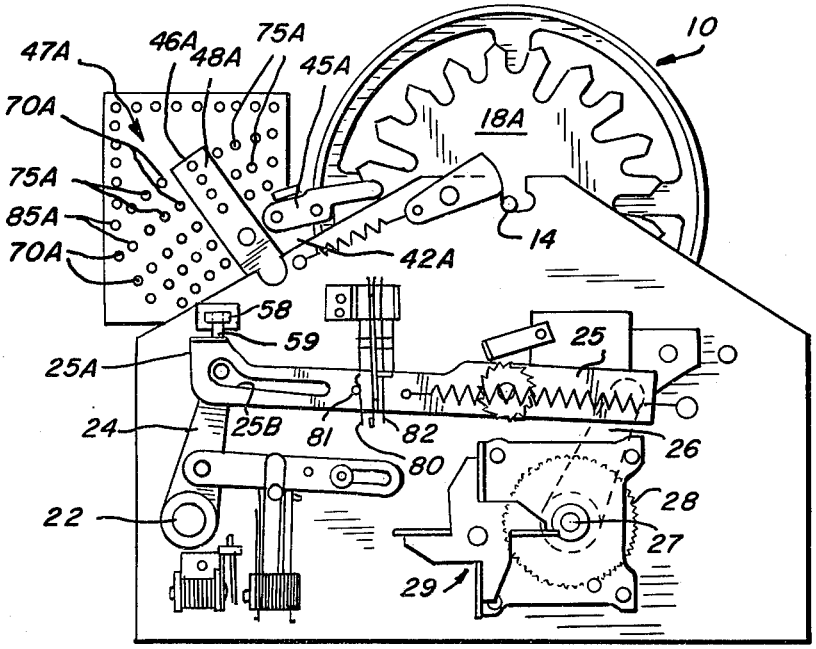
FIG. 4 is a side elevational view of the side of the apparatus opposite from that shown in FIG. 2.

A delayed action of the toggle trigger means is achieved through the mechanism shown to reduced scale in FIG. 4 (depicting the opposite side of the chassis from that seen in FIG. 2), wherein the opposite end of the cocking shaft 22 is joined to a lever 24 connecting through a long timing system arm 25 to another lever 26 fastened on a timer shaft 27 to which is also affixed one of the timing gears 28 of a known type of timer unit 29 operative to maintain the return or counterclockwie motion (as seen in FIG. 3) of shaft 27 at a slow rate in order to provide a short spinning interval for the reels 10, 11, 12, 13.

As timer shaft 27 turns slowly, a coupling lever 38 (FIG. 3) affixed thereto (there being one of these levers 38 and associated elements for each reel) moves its offset coupling flange 38D ahead of the timing lever 39, thereby permitting the latter and the associated drive bar 40 to move slowly back toward the right in FIG. 3 until the end of the long trigger slot 40D in FIG. 3 engages and moves a trip pin 52 on the trigger lever 50 to break the toggle and permit the corresponding indexing lever means 42D to advance rapidly into a slot 19 in the associated selector disc 18D and stop the reel 13 at a position of rest as aforesaid.

It is to be understood that each of the four reels 10, 11, 12, 13 has associated therewith a selector disc like 18D, as well as a corresponding indexing lever means like 42D, toggle levers 20, 21, trigger levers 50, etc., such as just described in connection with FIG. 3. It will be evident that by the simple device of having the respective long trigger slots 40D in the several timer drive bars 40 made in successively increasing length, the release of the four indexing lever means 42A, 42B, 42C, 42D, and therefore the resultant stoppage of the respective reels, is caused to occur in sequence from left to right, the reel 10 stopping first, and so on with the fourth reel 13 being the last to come to rest. It will be noted that each indexing lever means 42A, 42B, 42C, 42D actually consists of a lower lever part 43A and an upper lever part 43 on which is mounted the selector finger 45D (see FIG. 3) with an interposed spring means 44 mounted on the supporting axle 41 to impositively couple lever 43A with upper lever part 43, permitting any one of the indexing lever means 42A, 42B, 42C, 42D to remain in engagement with its coacting selector disc 18A, 18B, 18C, 18D while others are disengaged.

Referring to FIG. 1 and in accordance with the present invention, the indicia or symbols carried by each of the reels 10, 11, 12, 13, will be comprised of at least two types, one type consisting of "Win" symbols having potential score value and a second type consisting of "Hold" symbols without score value but which are important and unique to the operation of the present apparatus. The "Win" symbols are mounted at spaced intervals on the periphery of the reels 10, 11, 12, 13 and are shown in FIG. 1 as having the form of one, two and three short bars. Combinations of these "Win" symbols have predetermined score values. Interspersed between the "Win" symbols on the periphery of each of the reels 10, 11, 12, 13 are "Hold" symbols and blank spaces having no score value. The circumferential position of each of the symbols and the blank spaces about the periphery of the reels 10, 11, 12, 13 is coordinated with the positions of electrical "Hold" contacts 70A, 70B, 70C, 70D, "Win" contacts 75A, 75B, 75C, 75D, and "Blank" contact 85A, 85B, 85C, 85D in the contact banks 47A, 47B, 47C, 47D, respectively, associated with each of the reels 10, 11, 12, 13, respectively, as will be described hereinafter.

The specific symbols used to designate a "Win" or a "Hold" may be of any desired character suitable to whatever amusement, game or functional purpose may be involved, and are preferably read or viewed horizontally at a particular position referred to as the viewing area or indexed position. Usually the entire apparatus will be housed in some form of cabinet (not shown) concealing the mechanisms but provided with a window or sight opening aligned with said indexed position and represented by the viewing area designated 67 and enclosed by dash-dot lines in FIG. 1.

In accordance with the present invention electromechanic means are provided for automatically holding or locking in indexed position during a succeeding play cycle any of the reels 10, 11, 12 or 13 having a "Win" symbol in indexed position in the viewing area 67 when and only when one or more of the other reels has a "Hold" symbol simultaneously indexed in the viewing area 67 with the "Win" symbol. Thus, when the foregoing conditions are present, the appropriate circuitry to be described hereinafter will activate the holding solenoids or coils 54A, 54B, 54C, 54D (see FIG. 5) associated with the reels 10, 11, 12, 13, respectively, which had the "Win" symbol indexed in the viewing area and the solenoid plungers 53A, 53B, 53C, 53D associated therewith will be moved from its normal non-holding position of FIG. 5 with the corresponding blocking lever 56A, 56B, 56C, 56D, respectively, disposed at one side of the indexing lever guide slots 68A, 68B, 68C, 68D, respectively, to shift the end portion of the blocking levers 56A, 56B, 56C, 56D across the slots 68A, 68B, 68C, 68D, respectively, so that the corresponding indexing lever means 42A, 42B, 42C, 42D, cannot be fully retracted into its slot and thus the end of the selector fingers 45A, 45B, 45C, 45D, cannot be moved out of indexing engagement with its selecting discs 18A, 18B, 18C, 18D, respectively, thereby preventing the selecting discs 18A, 18B, 18C, 18D being spun during the next operation of the apparatus actuating or spinning levers 17A, 17B, 17C, 17D. In the event that any holding solenoid or coil 54A, 54B, 54C, 54D is energized, a holding control or supervisory switch 60 (FIG. 3) on the back of the machine will also be actuated by a shift rod 61 slidable crosswise of the machine. This rod 61 is normally mechanically shifted toward the left in FIG. 5 by a spring means so that pins 59A, 59B, 59C, 59D on the upper face of the rod 61 will bear against, and pivot blocking levers 56A, 56B, 56C, 56D, respectively, and move the blocking levers 56A, 56B, 56C, 56D into non-blocking position.

In order to hold the blocking levers 56A, 56B, 56C, 56D in blocking position after a brief energization of any of the coils 54A, 54B, 54C, 54D so as to avoid keeping these coils energized for extended periods, the associated latching levers 62A, 62B, 62C, 62D (FIG. 5) which are pivotally mounted are urged by associated springs to present their offset end portions 64A, 64B, 64C, 64D, respectively, behind and in the path of these offset end portions of the blocking levers 56A, 56B, 56C, 56D, so that the latter cannot be returned to normal non-blocking position by rod 61 once their corresponding solenoids are energized, notwithstanding the effort of the normalizing spring means associated with the supervisory-switch operating bar 61. It will also be evident that each blocking lever 56A, 56B, 56C, 56D when in non-blocking position prevents movement of the corresponding latching lever 62A, 62B, 62C, 62D, respectively, into latching position.

Figure 5:
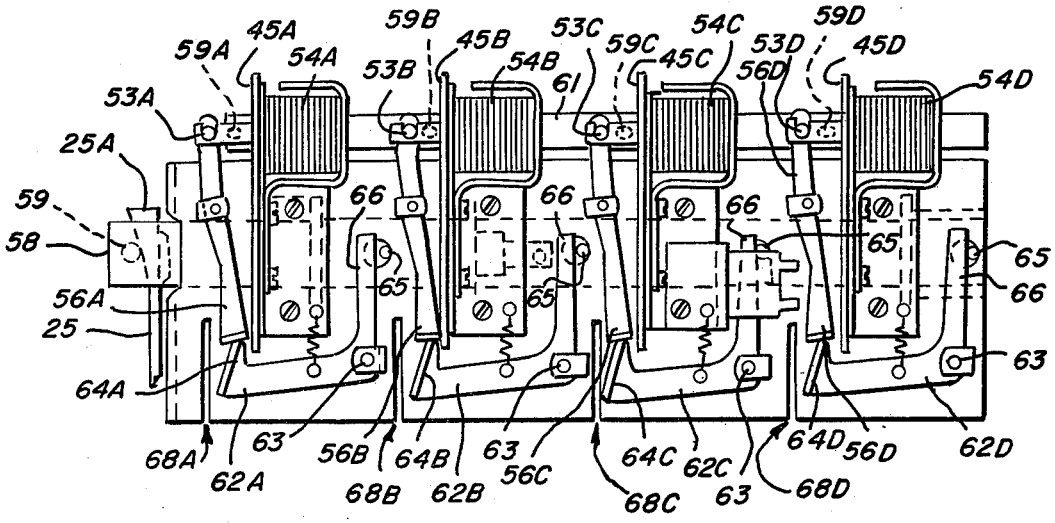
FIG. 5 is a fragmentary top plan view of the reel holding mechanism of the apparatus of FIG. 1.

Means for restoring any or all holding or blocking levers 56A, 56B, 56C, 56D and their associated latching levers 62A, 62B, 62C, 62D to normal non-blocking condition, includes the lateral slide or reset bar 58. The reset bar 58, as best shown in FIG. 5, is provided with studs 65 which project upwardly through the base plate adjacent the tails 66 of the latch levers 62A, 62B, 62C, 62D. Thus, when the reset bar 58 is shifted to the left in FIG. 5, the studs 65 will all bear against the latch tails 66 and pivot the latching levers 62A, 62B, 62C, 62D, so that all holding or blocking levers 56A, 56B, 56C, 56D can be returned to their normal non-blocking position, as by associated spring means.

Mechanical means are provided for automatically shifting the lateral restoring or reset bar 58 to the left toward the end of each operating cycle of the apparatus. Thus, as best illustrated in FIGS. 4 and 5, the timing system arm 25 is movable toward the left and then back toward the right during each play cycle, and on the leftward motion of the arm 25 the leg 25A thereon is depressed and passes under the depending pin 59 on the end of the reset bar 58, because of the shape of the slot 25B. On the motion of reset bar 58 to the right, however, the camming surface of the lug 25A engages the depending pin 59 (best shown in FIG. 5) and cams the pin 59, and hence reset bar 58, toward the left in FIG. 5, thereby releasing all of the latching levers 62A, 62B, 62C, 62D and allowing the blocking levers 56A, 56B, 56C, 56D, respectively, to be moved by its normalizing spring to reset or non-blocking position.

Figure 6:
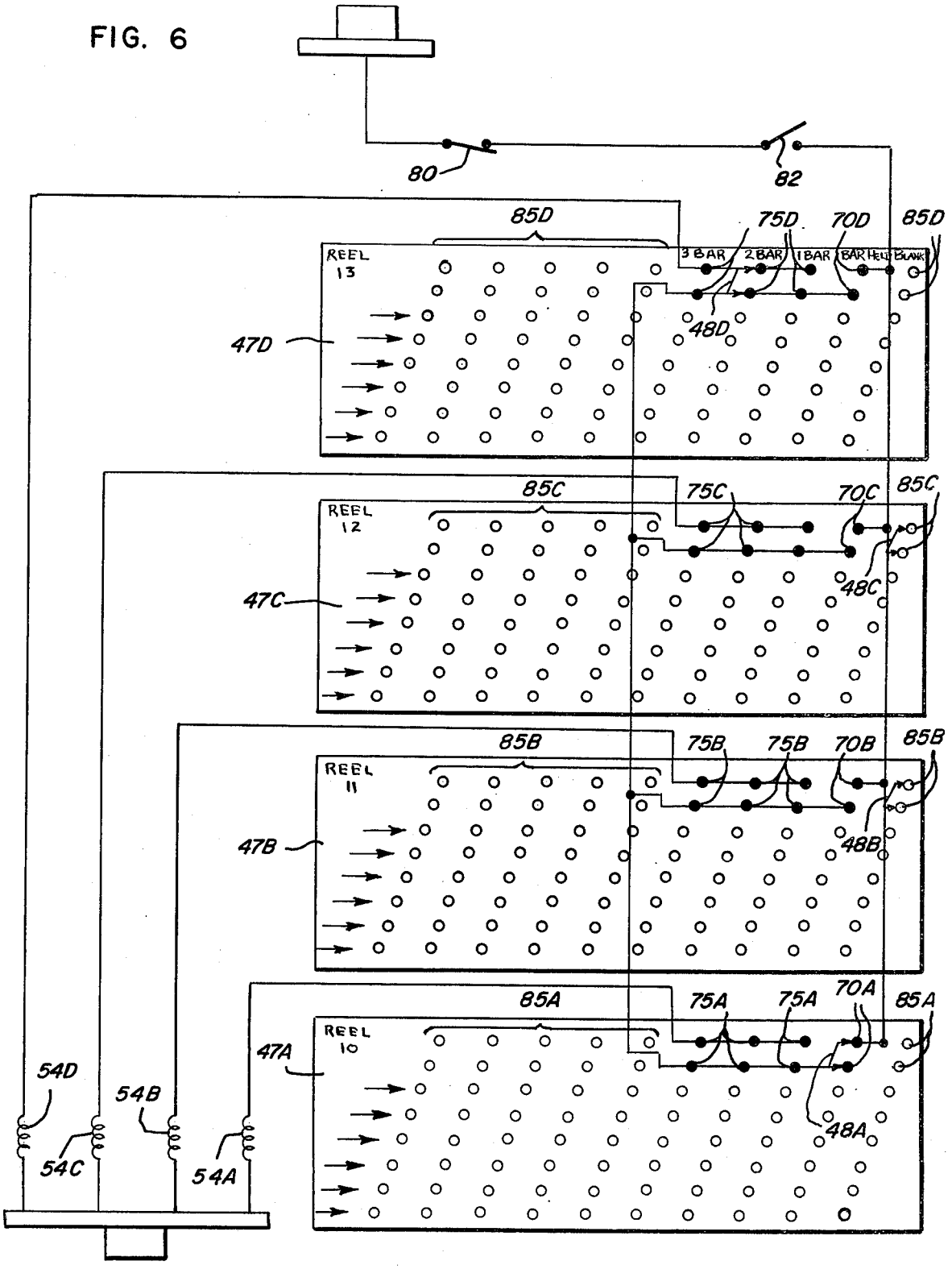
FIG. 6 is a fragmentary schematic circuit diagram illustrative of the operation of the automatic-hold feature of the apparatus of FIG. 1.
Figure 9:
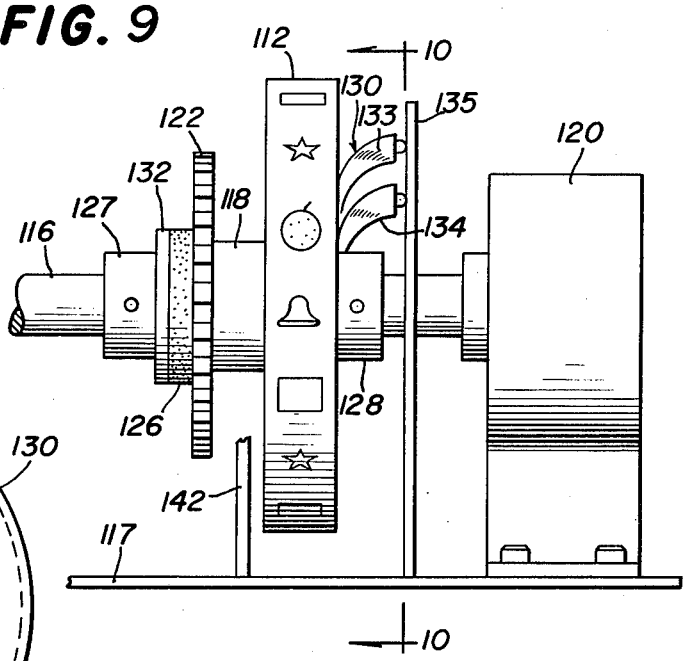
FIG. 9 is a fragmentary front elevational view of the apparatus shown in FIG. 8.
Figure 10:
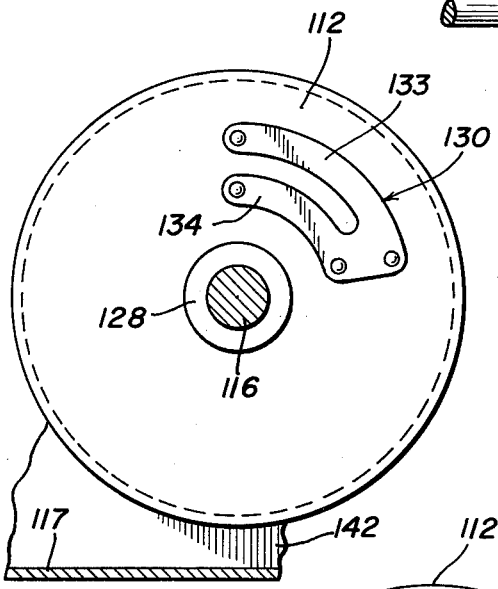
FIG. 10 is a sectional view partially in elevation taken along the lines 10—10 of FIG. 9.
Figure 11:
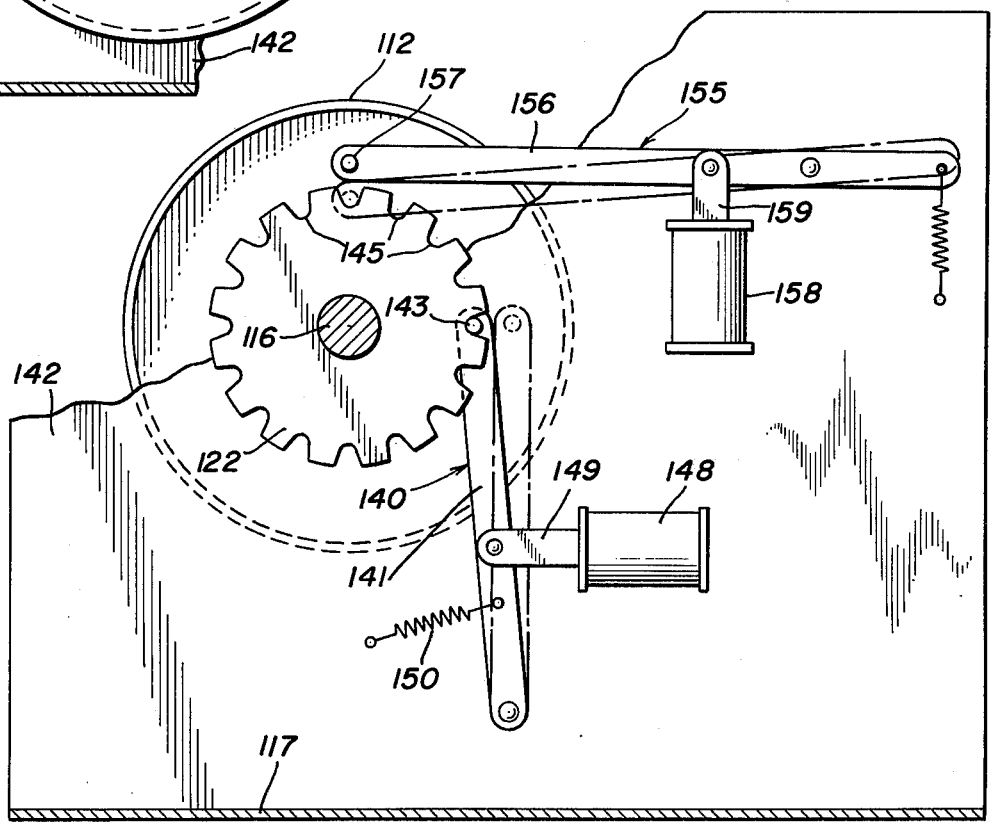
FIG. 11 is a vertical sectional view partially in elevation taken along lines 11—11 of FIG. 8.
Figure 12:
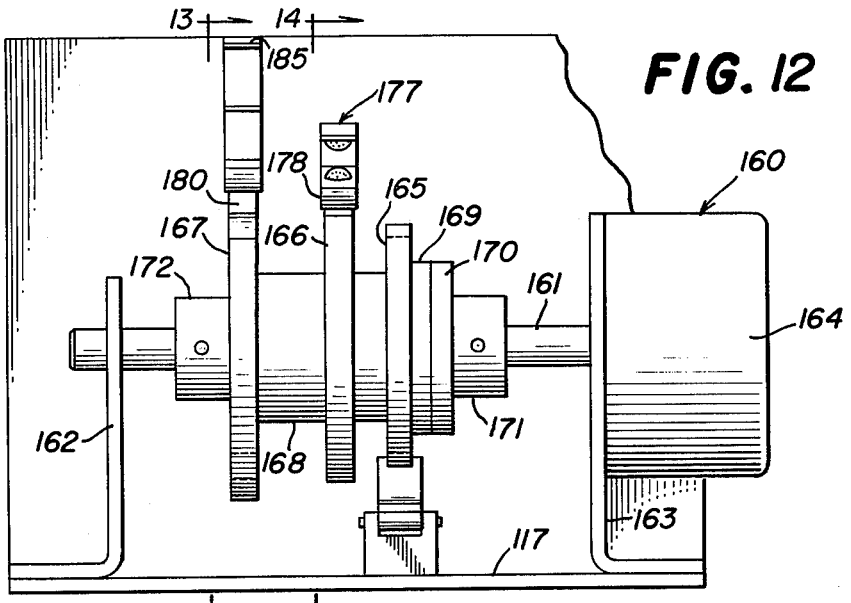
FIG. 12 is a fragmentary front elevational view of a portion of the control mechanism of the apparatus of FIG. 7.
Figure 13:
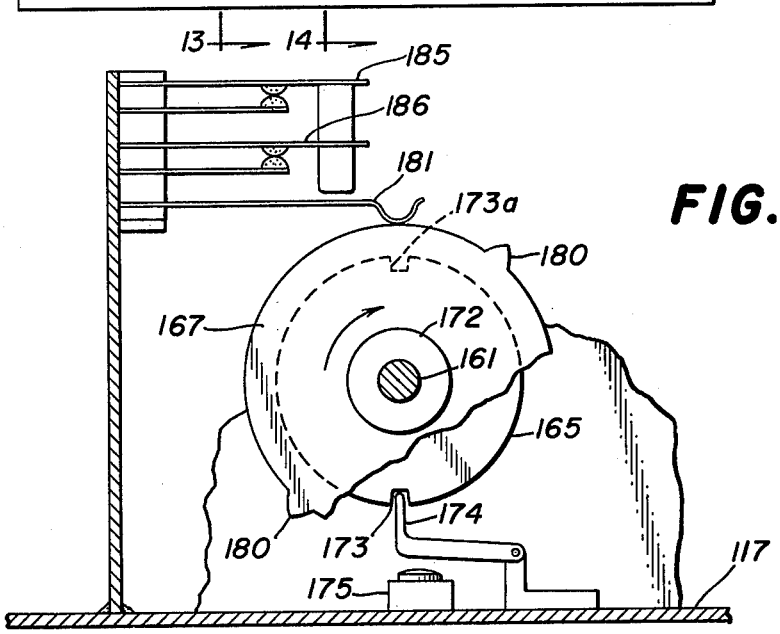
FIG. 13 is a vertical sectional view partially in elevation taken along the lines 13—13 of FIG. 12.
Figure 14:
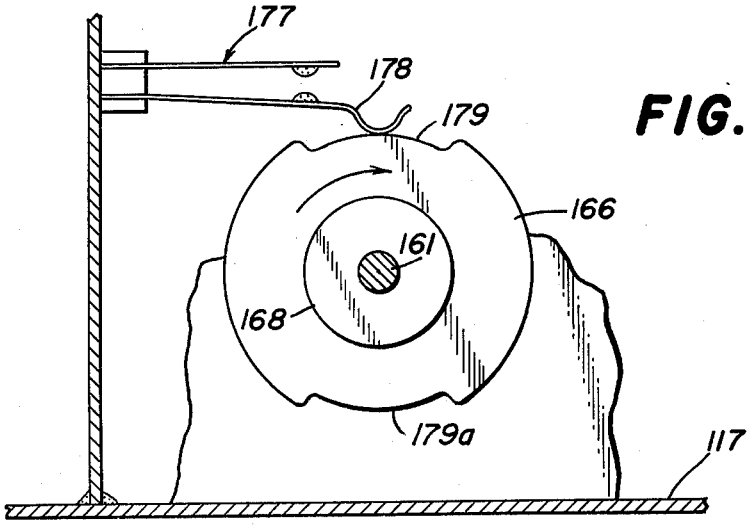
FIG. 14 is a vertical sectional view partially in elevation taken along the lines 14—14 of FIG. 12.

Electrical means are provided for actuating and controlling the mechanical means which provides the automatic hold feature of the present apparatus. Thus, the electrical contact banks 47A, 47B, 47C, 47D, in addition to having the usual contacts providing electrical connections for the score award circuits, contain two rows of electrical contacts which are unique to the present apparatus. In the fragmentary schematic electrical circuit diagram shown in FIG. 6, the two top rows of contacts in the contact banks 47A, 47B, 47C, 47D contain the electrical contacts for implementing the automatic hold feature. These two upper rows of contacts are arranged in vertically disposed electrical pairs with some of the pairs being "Hold" contacts 70A, 70B, 70C, 70D and others being "Win" contacts 75A, 75B, 75C, 75D. The two upper rows of contacts also have vertically disposable pairs of "Blank" contacts 85A, 85B, 85C, 85D, which are not connected to any electrical circuit. As illustrated in FIG. 4, the contacts 70A, 70B, 70C, 70D and 75A, 75B, 75C, 75D are interspersed with the "Blank" or dead contacts along the length of the two upper rows. In FIG. 6 for simplification a single "Hold" contact 70A, 70B, 70C, 70D and three types or species of "Win" contacts 75A, 75B, 75C, 75D are shown arranged in consecutive order. The sequence in which the contacts 70A, 70B, 70C, 70D and 75A, 75B, 75C, 75D are actually arranged in the two upper rows of contacts in actual practice will correspond to the sequence in which the symbols appear on the reels 10, 11, 12, 13.

The electro-mechanic means which utilize the aforesaid "Hold" and "Win" contact banks 47A, 47B, 47C, 47D for automatically actuating the hold coils or solenoids 54A, 54B, 54C, 54D, include the selector contact wipers 46A, 46B, 46C, 46D carrying the contact bridging means 48A, 48B, 48C, 48D, respectively. The contact bridging means 48A, 48B, 48C, 48D are adapted to electrically connect or "bridge" one of the vertically disposed pair of "Hold" contacts 70A, 70B, 70C, 70D or one of the pairs of "Win" contacts 75A, 75B, 75C, 75D, whenever a "Hold" or a "Win" contact is indexed in the viewing area, respectively. When neither a hold nor a "Win" contact is indexed on a particular reel (i.e., nothing but a blank appears in the viewing area), the contact bridging means 48A, 48B, 48C, 48D will contact one of the pairs of "Blank" contacts 85A, 85B, 85C, 85D which are not connected with any electrical circuit in the corresponding contact bank 47A, 47B, 47C, 47D. Since the radial depths of the notches 19 in the selector discs 18A, 18B, 18C, 18D of reels 10, 11, 12, 13, respectively, are different, the selector contact wipers 46A, 46B, 46C, 46D and thus the contact bridging means 48A, 48B, 48C, 48D will assume different angular positions relative to the contact banks 47A, 47B, 47C, 47D depending on the indexed position of the reels 10, 11, 12, 13; thereby causing each of the contact bridging means 48A, 48B, 48C, 48D to engage different electrical contacts (i.e., either a "Hold" contact 70A, 70B, 70C, 70D, a "Win" contact 75A, 75B, 75C, 75D or a "Blank" electrically dead contact 85A, 85B, 85C, 85D) in contact banks 47A, 47B, 47C, 47D and set up different combinations of circuit connections, depending upon the angular position in which the respective reels 10, 11, 12, 13 are indexed.

The "Hold" contacts 70A, 70B, 70C, 70D are arranged in contact banks 47A, 47B, 47C, 47D so as to be electrically connected in series with the "Win" contacts 75A, 75B, 75C, 75D, and the "Win" contacts 75A, 75B, 75C, 75D are adapted to be connected electrically in series with the holding solenoids 54A, 54B, 54C, 54D, respectively, whenever a "Win" symbol is simultaneously indexed with a "Hold" symbol in the viewing area 67 of the apparatus. Since the "Win" contacts 75A, 75B, 75C, 75D are interposed in the electrical control circuit between the hold solenoids 54A, 54B, 54C, 54D and "Hold" contacts 70A, 70B, 70C, 70D, electric current will flow from the positive power source to energize one or more of the hold solenoids 54A, 54B, 54C, 54D only if at least one pair of the "Win" contacts 75A, 75B, 75C, 75D and one pair of "Hold" contacts 70A, 70B, 70C, 70D are simultaneously "bridged".

Referring to FIG. 6 of the drawing which illustrates a suitable scanning circuit; the normally closed holding coil pulsing main switch 80 is opened and the normally open pulsing switch 82 is closed as a result of the movement of the timing system arm 25 and pin 81 thereon to the left as viewed in FIG. 4, when the manual operating lever 17 is pulled to effect spinning of the reels 10, 11, 12, 13. The switches 80, 82 remain so disposed during most of the play cycle until all the reels 10, 11, 12, 13 have completed their spin and have been indexed. Then, before the main game control switch 80 is closed ending the play cycle, all the holding solenoids 54A, 54B, 54C, 54D are automatically mechanically reset to the "non-hold" position by cam surface 25A on the timing arm 25 moving the reset bar 58 to the left during the return movement of the arm 25 and thereby releasing the hold coil latches 62A, 62B, 62C, 62D, as heretofore described. The further movement of the timing arm 25 and pin 81 thereon to the right will then effect closing of the pulsing circuit main switch 80 and a brief pulsing current will pass through switch 80, through the previously closed switch 82, and through the circuit or circuits in contact banks 47A, 47B, 47C, 47D which have both a "Hold" contact 70A, 70B, 70C, 70D and a "Win" contact 75A, 75B, 75C, 75D simultaneously "Bridged" to energize one or more of the holding solenoids 54A, 54B, 54C, 54D.

Once during each play cycle after each reel 10, 11, 12, 13 has been indexed and immediately after all the holding solenoids 54A, 54B, 54C, 54D have been reset to non-blocking position, each of the contact banks 47A, 47B, 47C, 47D is automatically "scanned" in the foregoing manner to determine whether a "Win" symbol and a "Hold" symbol are both indexed in the viewing area 67 in order to effect immediately energizing or re-energizing one or more of the holding solenoids 54A, 54B, 54C, 54D and thereby hold one or more of the reels 10, 11, 12, 13 in their indexed position in the following play cycle. The circuits shown in FIG. 6 illustrate having a "Hold" symbol indexed on reel 10 and a two-bar "Win" symbol indexed on reel 13 so that reel 13 will be held in indexed position during the following play cycle. The reels 11 and 12 have been indexed in the play cycle just completed in the "Blank" no-Hold, no-Win position.

After the scanning operation has been completed and one or more solenoids 54A, 54B, 54C, 54D activated, the switch 82 is opened by the timing arm 25 of the timing system at the end of the play cycle with switch 80 remaining closed. Switch 82 is held in open position until manual operating lever 17 is again pulled to initiate another play cycle. When the switch 82 is closed at the beginning of the next play cycle by the movement of the operating lever 17, switch 80 is opened so that no current will be supplied to the hold scanning circuit until the timing arm 25 has substantially completed its return movement to the right, as herein described. Once electrically pulsed (i.e. moved into holding position), the holding solenoids 54A, 54B, 54C, 54D are mechanically latched and held in holding position until mechanically reset, as heretofore described. Thereafter and before the end of the play cycle the holding solenoids 54A, 54B, 54C, 54D are again scanned and re-energized electrically in the above described manner, if the correct circuitry through the contact banks 47A, 47B, 47C, 47D is present.

An amusement apparatus disclosing a further embodiment of the present invention is shown in FIGS. 7–15 and comprises a console-type cabinet 10 with preferably four mechanical reels 112, 113, 114, 115 disposed in spaced side-by-side relationship and rotatably mounted therein. Each of the reels 112, 113, 114, 115 has a plurality of symbols including at least one but preferably a plurality of "Win" symbols having potential score value and at least one but preferably a plurality of "Hold" symbols randomly arranged with each other and interspersed with blank spaces or other symbols having no score value. In the form illustrated the symbol arrangement consists of 14 equally spaced "Win", "Hold" and "No value" symbols formed on the peripheral surface of each reel and with one of the symbols on each of the reels adapted to being randomly displayed in a viewing area or window 119 formed in a front panel 111 of the cabinet 110. Each of the mechanical reels 112, 113, 114, 115 is mounted on a horizontally disposed axle 116 supported on a base plate 117 within the cabinet 110. An electric motor 120 is connected directly with the axle 116 to effect rotation of the axle 116 and associated reels and sprocket wheels.

The hub 118, 118*a,* 118*b,* 118*c* of each of the reels 112, 113, 114, 115, respectively, has fixedly secured thereto a ratchet or index wheel 122, 123, 124, 125. Each of the index wheels 122, 123, 124, 125 has a friction disc 126, 126*a,* 126*b,* 126*c* secured to the outer lateral surface thereof. The reels 112, 113, 114, 115 and index wheels 122, 123, 124, 125 are adapted to be rotatable as a unit relative to the axle 116, but can be rotated with the axle 116 by means of the friction clutch elements **132, 132*a*, 132*b*, 132*c* which are resiliently urged into contact with the friction disc 126, 126*a*, 126*b*, 126*c*, respectively, by a bushing 127, 127*a*, 127*b*, 127*c*, respectively. A bushing 128, 128*a*, 128*b*, 128*c* is secured to the axle 116 and prevents the reels 112, 113, 114, 115, respectively, being moved longitudinally on the axle 116**.

A bridge wiper element **130, 130*a*, 130*b*, 130*c* is fixedly secured to the inner lateral surface of each of the reels 112, 113, 114, 115, respectively, and rotates with the respective reels. Each of the wiper elements 130, 130*a*, 130*b*, 130*c* has a pair of spaced electrically separated resilient wiper contacts 133, 134; 133*a* 134*a*; 133*b*, 134*b*; 133*c*, 134*c*; respectively, which are adapted to slidably and resiliently engage a fixed electrical contact plate 135, 135*a*, 135*b*, 135*c* having an outer row of spaced electrical contacts 137, 137*a*, 137*b*, 137*c* and an inner row of electrical contacts 138, 138*a*, 138*b*, 138*c*. Each of the contact plates 135, 135*a*, 135*b*, 135*c* is affixed to the base plate 117 of the cabinet 110**.

Each of the indexing ratchet wheels 122, 123, 124, 125 has operatively associated therewith a random indexing means 140 (see FIG. 11), which comprises an index lever 141, pivotally mounted on a stationary support panel 142 which is affixed to the base plate 117 of the cabinet 110. The index lever 141 has an index pawl 143 mounted on the outer end thereof which is adapted to engage in one of the ratchet wheel recesses 145 corresponding to one of the symbols in the reel 112 and thereby randomly index one of the said symbols in the viewing area 119 of the cabinet 110. The index lever 141 is actuated by an index release solenoid 148 having the outer end of the solenoid armature 149 connected with the index lever 141. A spring member 150 normally holds the pawl 143 in engagement with the recess 145 of the ratchet wheel 122 and the ratchet wheel 122 is held in a fixed or indexed position until the index release solenoid 148 is activated.

Each of the indexing or ratchet wheels 122, 123, 124, 125 also has operatively associated therewith a hold or locking means 155 (see FIG. 11) which is adapted to hold one or more of the reels 112, 113, 114, 115, respectively, in a fixed position during a play cycle while one or more of the other reels 112, 113, 114, 115 is rotated by the axle 116. The hold or locking means 155 comprises a locking lever 156 pivotally mounted between the ends thereof on a support panel 142 which is attached to the base plate 117. A locking pawl 157 is mounted on the outer end of the lever 156 and the pawl 157 is adapted to engage in one of the recesses 145 in the periphery of the ratchet wheel 122. A hold or locking solenoid 158 and the armature 159 is operatively connected with the locking lever arm 156 and effects movement of the lever 156 and draws the pawl 157 into locking engagement with the ratchet wheel 122 when the solenoid 158 is activated.

A master control mechanism 160 (see FIG. 12) is provided for operating the electric motor 120 and the several solenoids associated with the indexing means 140 and hold means 155 and comprises an axle 161 supported between spaced brackets 162, 163 mounted on the base plate 117. An electric motor 164 is connected directly to axle 161 to effect rotating thereof. The axle 161 has a plurality of essentially circular control unit cams 165, 166, 167 fixedly secured to a hub member 168 mounted on the axle 161 with the hub member 168 being rotatably movable relative to the axle 161. The assembly of cams 165, 166, 167 can be rotated as a unit with the axle 161 by means of a fraction clutch disc 169 secured to the lateral surface of the hub 168 being resiliently engaged by a friction clutch member 170 which is pinned to the axle 161. A bushing 172 is in contact with the opposite end of the hub 168 and is pinned to the axle 161 to prevent longitudinal movement of the assembly of cams along the shaft 161.

The control unit indexing cam 165 (see FIG. 13) has formed on the outer circumference thereof two oppositely disposed detents or recesses **173, 173*a* spaced 180° which are adapted to receive the outer end of an armature pawl 174 normally urged into seating engagement in one of the detents 173, 173*a* to prevent rotation of the control unit cams 165, 166, 167. A control unit indexing coil 175 is operatively associated with the armature 174 to effect withdrawing the pawl from either of the detents 173, 173*a***.

The control cam 166 (see FIG. 14) has two diametrically oppositely disposed short flat cam surfaces **179, 179*a* extending along the periphery thereof and has operatively associated therewith a control unit master switch 177 which has a resilient arm 178 adapted to contact the outer peripheral surface of the cam 166 and to effect closing of the switch 177 when the cam 166 is rotated from its normal rest position in either of the flat recessed cam surfaces 179 or 179*a***.

The control cam 167 (see FIG. 13) is provided with two outwardly extending pulsing cam surfaces **180, 180*a* spaced 180° on the outer periphery thereof and has operatively associated therewith a resilient switch actuating arm 181 which resiliently contacts the outer periphery of the cam 167 during the rotation thereof. The resilient arm 181 is adapted to pulse open the control leaf switches 185, 186 when the cam 167** is rotated.

From FIG. 15 of the drawing showing the electrical control circuit for the apparatus of FIGS. 7–14, it will be evident that when a coin is inserted in the apparatus the coin switch 190 will be closed, momentarily energizing the coin relay coil 191 which will remain energized even after coin switch 190 is opened by current flowing through the normally closed control unit switch 186 and coil relay switch 187 which is closed when the coin relay coil 191 is initially energized. The coin relay coil 191 also closes coin relay switch 192 so that when the operating switch 195 is momentarily depressed by the operator the control unit index coil 175 is activated to withdraw the pawl 174 from detent 173 on the control unit cam 165, and all the control unit cams 165, 166, 167 will then be rotated by control unit motor 164 through the friction clutch element 170. The cam 166 will close switch 177, causing the indexing release coils **148, 148*a*, 148*b*, 148*c* to be energized; thereby allowing each of the reels 112, 113, 114, 115 to be rotated provided one or more of the said reels are not restrained by a hold means 155 which is operatively associated with each of the said reels. The reels 112, 113, 114, 115 will continue to be rotated until the control unit cams 165, 166, 167 have advanced approximately 180°, whereupon switch 177 will drop open, de-energize indexing release coils 148, 148*a*, 148*b*, 148*c* and allow the respective index lever 141 associated with each of the reels to engage ratchet wheel 122, 123, 124, 125, and randomly index the reels 112, 113, 114, 115. Switch 186 will then be pulsed open by cam 167 to de-energize the coin relay coil 191 and open coil relay switch 187. Thereafter, the pawl 174 on the end of the index coil armature will drop into the detent 173 on the index unit cam 165, thereby stopping the rotation of the control unit cams 165, 166, 167** and ending a cycle of operation which comprises the normal "play" of the apparatus.

The operation of the "Hold" mechanism of the apparatus shown in FIGS. 7–14 will be explained by assuming that the apparatus has just completed one cycle or "play" and that the reels have been randomly indexed so as to display a "Hold" symbol on reel 115 and a "Win" symbol on reel 112. The series of electrical contacts designated 137, which are mounted on each of the contact plates 135, 135*a,* 135*b,* 135*c* associated with reels 112, 113, 114, 115, respectively, are so wired that when a "Hold" symbol on reel 115 is indexed in the viewing area, the electrical contacts 013–014 on plate 135*c* (which exemplifies the several "Hold" contacts on plate 135*c*) will be connected by the bridge wiper arm 133, and close the electrical circuit to the hold relay solenoid or coil 199. The hold relay coil 199 thus energized, will remain energized (even when reel 115 is rotated and contacts 013 and 014 no longer bridged) through the circuit comprising the normally closed unit control switch 185 and the hold relay switch 195*a* which was closed when hold relay coil 199 was initially energized by the bridging of contacts 013–014. The hold relay coil 199 remains closed until switch 185 is pulsed open by the cam surface 180 on the rotating cam 167 shortly before the end of each play cycle. However, if a "Hold" symbol is again indexed on any one of the reels 113, 114, 115, the circuit to the hold relay coil 199 will again be closed by bridge wiper arm 133, in the herein described manner. Thus, even though control switches 185 and 186 are pulsed open shortly before the end of each play cycle, the hold relay coil 199 again will be energized before the end of the play cycle, first by the bridging of contacts 013–014 and then by the circuit through switch 185 and hold relay switch 195*a.* The hold relay coil 199 remains closed through most of the immediately following play cycle until after all the reels are indexed, at which time the cam 167 will have rotated 180 degrees and cam surface 180*a* will pulse open control switches 185 and 186 so that the hold relay coil 199 will be de-energized and remain de-energized unless a "Hold" symbol has again been indexed in the viewing area 119.

The series of electrical contacts 138 on contact plate 135 which is associated with reel 112 is wired so that the contacts 103–104 which exemplifies the several "Win" contacts on plate 135 will be connected by bridge wiper 134 whenever a "Win" symbol on reel 112 is indexed in the viewing area. And, since the normally open hold relay switch 100 is adapted to be closed when the hold relay coil 199 is energized, it will be evident from FIG. 15 that when a "Win" symbol on reel 112 is also indexed in the viewing area 119 simultaneously with the indexing of a "Hold" symbol on reel 115, the hold coil 158 associated with reel 112 will be energized and lock reel 112 in its indexed position. Hold coil 158 will remain energized and will hold reel 112 in indexed position so long as the hold relay coil 199 is energized. Thus, when the coin switch 190 is again activated at the start of the next "play cycle", the reel 112 will remain locked in indexed position and will not rotate with the other reels 113, 114, 115, since the contacts 103–104 are closed by the bridge wiper 134 and the energized hold relay coil 199 holds relay switch 100 closed, thereby completing the circuit to the hold coil 158 associated with reel 112.

If at the end of the foregoing play cycle, a "Hold" symbol is again indexed in the viewing area 119, the reel 112 will again be held in indexed position during the following play cycle. If the reel 113, for example, is also indexed so as to show a "Win" symbol and reel 114 a "Hold" symbol at the end of the above described second play cycle, both reels 112 and 113 will be held against rotation during the next play cycle by the hold mechanism in the above described manner. If no "Hold" symbol is indexed on any of the rotating reels 113, 114, 115 at the end of any play cycle, even though one to three "Win" symbols are displayed, the hold relay coil 199 will be de-energized and remain de-energized as a result of switch 185 being pulsed open by cam 167 and all four reels 112, 113, 114, 115 will be free to rotate during the following play cycle and a new sequence of play or "game" must commence.

If desired, an electrical signal light can be placed in parallel with the hold coils 158, 158*a,* 158*b,* 158*c* to receive electric current only when one or more of the reels 112, 113, 114, 115 are being held in index position by the automatic hold mechanism in accordance with the present invention.

It will be understood by those skilled in the art that other means for effecting rotation of the symbol display elements of the apparatus during a play cycle or play period can be used in addition to the motor driven means disclosed in FIGS. 8–16.

The term "electro-optical reel" is used herein to designate an electro-optical assembly which projects in sequence images of symbols on a self-contained translucent screen surface to simulate spinning reel action which gives the appearance of the rotation of a mechanical reel without requiring moving parts of any type. An "electro-optical reel" can be operated entirely by combinations of electronic elements as is well known in the electronic art and is within the scope of the present invention.

I claim:

1. An amusement apparatus having a plurality of symbol display elements each having a plurality of symbols of a first type which designate "Win" symbols and a plurality of symbols of a second type which designate "Hold" symbols, said apparatus normally operative in a play cycle for displaying one symbol from each display element sequentially in a viewing area, said display elements adapted to be indexed at the end of a play cycle to display in said viewing area one symbol from each said display element to form a combination of said symbols which can have a predetermined score value, and control means associated with said display elements for automatically holding in said viewing area during the next succeeding play cycle a said "Win" symbol when at least one of the symbols simultaneously indexed with said "Win" symbol in said viewing area at the end of the first mentioned play cycle is a "Hold" symbol; whereby a combination having increased score value can be built up stepwise in successive play cycles.

2. An amusement apparatus having a symbol viewing area and a plurality of symbol display elements with each said display element having a plurality of a first type of symbols which designate "Win" symbols having score value and a plurality of symbols of a second type which designate "Hold" symbols having no score value, each said display element when said apparatus is actuated being operative during a play cycle for displaying sequentially the symbols of each display element in said viewing area and indexing in said viewing area one symbol of each display element to form a selected combination of symbols at the end of a play cycle, and said symbol display elements having associated therewith control means adapted to automatically keep indexed on display in said viewing area during the next play cycle any said "Win" symbol of a display element which has been indexed in said viewing area whenever a said "Hold" symbol of another said display element is indexed in said viewing area simultaneously with said "Win" symbol while allowing each said display element which does not have a "Win" symbol indexed on display in said viewing area to be operative.

3. An amusement apparatus having a plurality of symbol display elements with each display element having a plurality of symbol some of which are designated "Win" symbols having score value and at least one other symbol of a second type which is designated a "Hold" symbol without score value, each said display element on actuation of the apparatus having means operative during a play cycle for displaying sequentially said symbols in a viewing area and indexing one of said symbols of each said element for display in said viewing area to form a random selected combination of symbols having potential score value at the end of the first play cycle, and said symbol display elements having associated therewith control means adapted to automatically keep indexed any said "Win" symbol on display in said viewing area during the next play cycle wherever a said "Hold" symbol of another display element is indexed in said viewing area simultaneously with a said "Win" symbol while allowing any said display element which does not have a "Win" indexed on display in said viewing area to be operative; whereby a combination having increased score value can be built up step-wise in successive play cycles without arbitrarily limiting the number of play cycles before a new random selected combination of symbols is formed in said viewing area.

4. In a method of operating an amusement apparatus having a plurality of symbol display elements each having a plurality of symbols of a first type which designate "Win" symbols having potential score value and a plurality of symbols of a second type which designate "Hold" symbols without score value with said apparatus when actuated adapted to display said symbols sequentially during a play cycle in a viewing area and indexing one said symbol from each display element in said viewing area at the end of a first play cycle to form a random selected combination of said symbols having a potential score value, the improvement comprising; Automatically holding any said "Win" symbol indexed in said combination on display in said viewing area during the next play cycle and during each succeeding play cycle so long as a said "Hold" symbol of a display element is simultaneously indexed in said viewing area with the "Win" symbol at the end of a play cycle; whereby a combination having increased score value can be built up step-wise in successive play cycles without arbitrarily limiting the number of play cycles before all the said display elements are allowed to be operative to form a new random selected combination of symbols in said viewing area.

5. A method of operating an amusement apparatus having a plurality of symbol display elements which are adapted to display sequentially one symbol of each display element in a viewing area of the apparatus during a play cycle with a plurality of said symbols on each display element being "Win" symbols having score value and a plurality of symbols which are without score value and which can be special "Hold" symbols comprising; randomly indexing one symbol of each display element in said viewing area at the end of the first play cycle to form a randomly selected combination of symbols having a potential score value, automatically holding in indexed position in said viewing area during the following play cycle any said "Win" symbol at the end of the play cycle indexed in the viewing area when a said "Hold" symbol of one said display element is simultaneously indexed in said viewing area with the "Win" symbol while allowing any said display element which does not have a "Win" symbol indexed on display in said viewing area to be operative on the following actuation of the apparatus; whereby a combination having increased score value can be built up step-wise in successive play cycles without arbitrarily limiting the number of play cycles before all the said display elements are allowed to be operated to form a new random selected combination of symbols in said viewing area.

6. A method of operating an amusement apparatus having a plurality of symbol display elements with each said display element adapted to display sequentially in a viewing area during a play cycle at least two distinct types of symbols including "Win" symbols which have score value and at least one "Hold" symbol which has no score value when on display in a said viewing area comprising; randomly indexing one symbol of each said display element in said viewing area at the end of a first play cycle to form a randomly selected combination of symbols having a potential score value, and automatically holding any said "Win" symbol dexed on display in said viewing area during the next play cycle and during each succeeding play cycle so long as any said "Hold" symbol of one display element is simultaneously indexed in said viewing area with a "Win" symbol of another said display element at the end of a play cycle while allowing any said display element which does not have a "Win" symbol indexed on display in said viewing area to be operative; whereby a combination of symbols having increased score value can be built up step-wise in successive play cycles without there being a predetermined number of play cycles before a new randomly selected combination of symbols is formed in said viewing area.

* * * * *